US008428799B2

(12) United States Patent
Cansiani et al.

(10) Patent No.: US 8,428,799 B2
(45) Date of Patent: Apr. 23, 2013

(54) AUTOMATED FUEL ECONOMY OPTIMIZATION FOR MARINE VESSEL APPLICATIONS

(75) Inventors: Kevin A. Cansiani, St. Clair Shores, MI (US); Tim J Clever, Waterford, MI (US)

(73) Assignee: GM Global Technology Operations LLC

( * ) Notice: Subject to any disclaimer, the term of this patent is extended or adjusted under 35 U.S.C. 154(b) by 932 days.

(21) Appl. No.: 12/365,501

(22) Filed: Feb. 4, 2009

(65) Prior Publication Data

US 2010/0198435 A1 Aug. 5, 2010

(51) Int. Cl.
*B63H 21/21* (2006.01)

(52) U.S. Cl.
USPC ..... 701/21; 440/1; 440/12.5; 114/285

(58) Field of Classification Search ..... 701/21; 114/285; 440/1, 12.5; *G05D 1/00; B63H 21/21*
See application file for complete search history.

(56) References Cited

U.S. PATENT DOCUMENTS

| | | | | | |
|---|---|---|---|---|---|
| 4,908,766 | A | * | 3/1990 | Takeuchi | 701/21 |
| 5,094,637 | A | * | 3/1992 | Nakamura | 440/1 |
| 5,171,172 | A | * | 12/1992 | Heaton et al. | 440/1 |
| 5,263,432 | A | * | 11/1993 | Davis | 114/286 |
| 5,352,137 | A | * | 10/1994 | Iwai et al. | 440/1 |
| 5,355,140 | A | * | 10/1994 | Slavin et al. | 342/386 |
| 5,433,634 | A | * | 7/1995 | Nakayama et al. | 440/1 |
| 5,491,636 | A | * | 2/1996 | Robertson et al. | 701/116 |
| 5,507,672 | A | * | 4/1996 | Imaeda | 440/1 |
| 6,273,771 | B1 | * | 8/2001 | Buckley et al. | 440/84 |
| 6,354,237 | B1 | * | 3/2002 | Gaynor et al. | 114/286 |
| 6,458,003 | B1 | * | 10/2002 | Krueger | 440/1 |
| 6,885,919 | B1 | * | 4/2005 | Wyant et al. | 701/21 |
| 7,311,058 | B1 | * | 12/2007 | Brooks et al. | 114/285 |
| 7,416,456 | B1 | * | 8/2008 | Gonring et al. | 440/1 |
| 7,617,026 | B2 | * | 11/2009 | Gee et al. | 701/21 |
| 2004/0193338 | A1 | * | 9/2004 | Kaji | 701/21 |
| 2008/0261466 | A1 | * | 10/2008 | Kishibata et al. | 440/1 |
| 2009/0117788 | A1 | * | 5/2009 | Kaji | 440/1 |
| 2009/0124141 | A1 | * | 5/2009 | Ito et al. | 440/1 |
| 2009/0215328 | A1 | * | 8/2009 | Daffey | 440/1 |
| 2010/0068950 | A1 | * | 3/2010 | Lundgren | 440/1 |
| 2010/0167601 | A1 | * | 7/2010 | Rzadki et al. | 440/1 |

FOREIGN PATENT DOCUMENTS

| | | | | |
|---|---|---|---|---|
| JP | 05201387 | A | * | 8/1993 |
| JP | 08040380 | A | * | 2/1996 |
| JP | 08156884 | A | * | 6/1996 |
| JP | 09286390 | A | * | 11/1997 |

* cited by examiner

*Primary Examiner* — Tuan C. To

(57) ABSTRACT

A method and system for operating a marine vessel includes a cruise control module operating the marine vessel at a speed and a trim control module positioning an outdrive into a plurality of trim positions. A fuel economy determination module determines a plurality of fuel economies for each of the trim positions and determines an efficient trim position from the plurality of fuel economies for each of the trim positions. An operation control module operates the marine vessel at the efficient trim position. A trim tab position may also be taken into account for efficient operation.

20 Claims, 4 Drawing Sheets

AUTOMATED FUEL ECONOMY OPTIMIZATION FOR MARINE VESSEL APPLICATIONS

FIELD

The present disclosure relates to marine vessels, and, more particularly to optimizing fuel economy for the vessel.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Many marine vessels have an outdrive that has a propeller that propels the vehicle while underway. The angle of the outdrive relative to the marine vessel is the outdrive trim angle. The outdrive trim angle can be moved to various positions while underway. Other variables may also affect the movement of the vessel through the water including, but not limited to, the trim tab position. Trim tabs are typically hydraulic devices that are used to control the attitude of the vessel. Trim tabs may control the pitch of the vessel as well as any listing of the vessel in the roll direction.

As the cost of fuel increases, so does the desirability of providing high fuel economy for the vessel. The outdrive trim angle and the trim tabs, if so equipped, can affect the fuel economy of the vessel.

SUMMARY

Accordingly, the present disclosure provides a system to increase the fuel economy for marine vessels by modifying the vessel operating characteristics that may include the outdrive trim angle and trim tab positions, if so equipped. The present disclosure provides a system and method that allow even a novice boater to achieve a high level of fuel economy.

In one aspect of the disclosure, a system for operating a marine vessel includes a cruise control module operating the marine vessel at a speed and a trim control module positioning an outdrive into a plurality of trim positions. A fuel economy determination module determines a plurality of fuel economies for each of the trim positions and determines an efficient trim position from the plurality of fuel economies for each of the trim positions. An operation control module operates the marine vessel at the efficient trim position.

In a further aspect of the disclosure, a method includes operating the marine vessel at a speed, positioning an outdrive into a plurality of trim positions, determining a plurality of fuel economies for each of the trim positions, determining an efficient trim position from the plurality of fuel economies for each of the trim positions, and operating the marine vessel at the efficient trim position.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present disclosure will become more fully understood from the detailed description and the accompanying drawings, wherein.

DETAILED DESCRIPTION OF THE PREFERRED EMBODIMENTS

Figure 1:
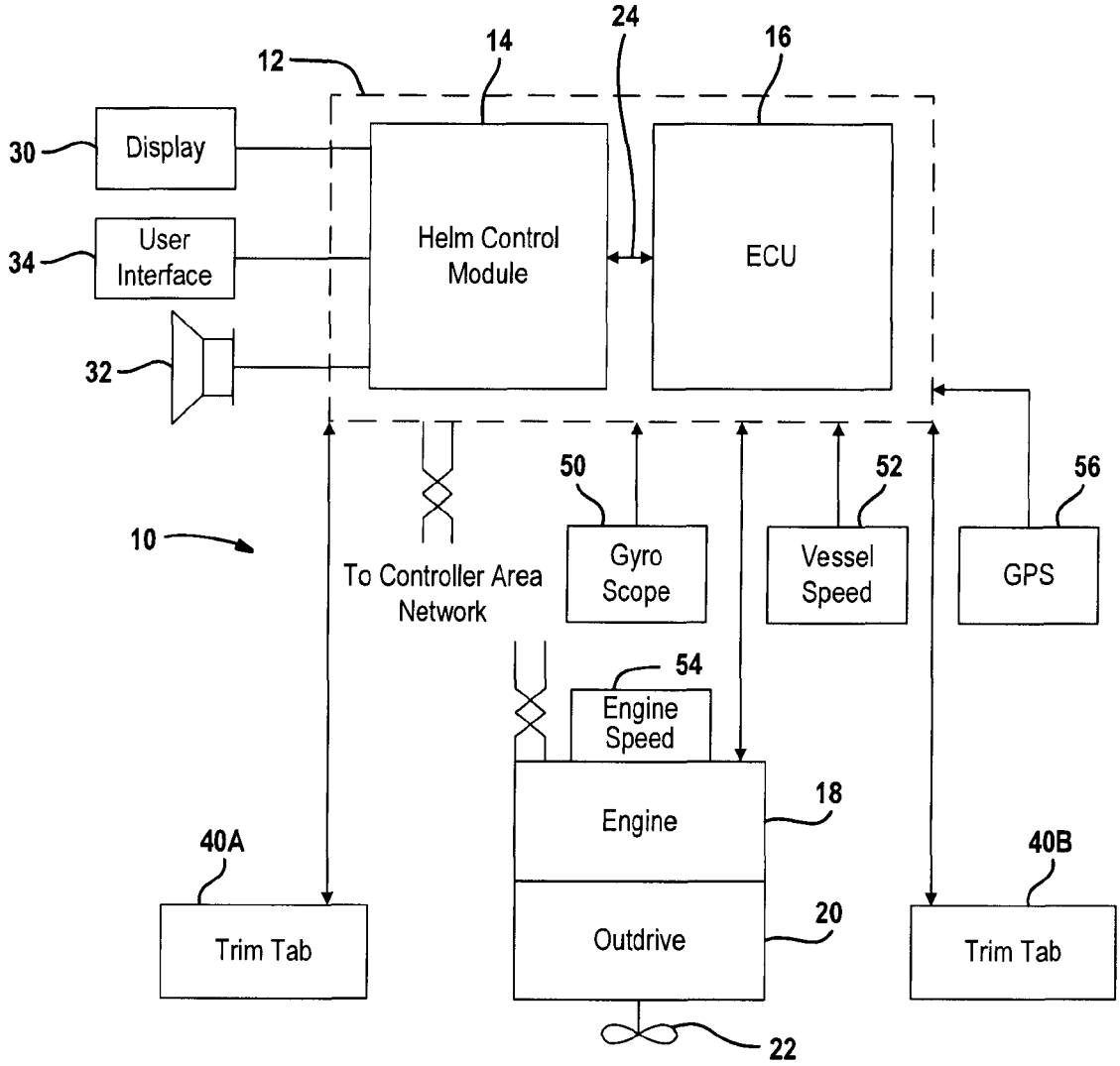
FIG. 1 is a functional block diagram of a vessel according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Referring now to FIG. 1, a marine vessel 10 having a controller 12 with a helm control module 14 and an engine control unit 16 is illustrated. The controller 12, the associated helm control module 14 and the engine control unit 16 are used to control an engine 18 and an outdrive 20. The engine 18 may be an internal combustion engine that is used to provide power for movement of the vessel 10. The engine 18 is mechanically coupled to the outdrive 20. The engine 18 delivers power through a shaft that is coupled to the outdrive 20. The outdrive 20 has gearing for the system and a propeller 22. The outdrive 20 has the ability to trim or modify its pitch relative to the vessel 10. By properly controlling the outdrive trim angle while underway, a vessel can achieve improved fuel economy during steady speed operation as will be described below.

The helm control module 14 is the main human control interface to the driver and the input/output components of the vessel. The helm control module 14 provides the user with an interface for initial setup and control of the system. The helm control module 14 may calibrate the actuators or sensors to be used in the system and report that information to the engine control unit 16. The helm control module 14 also provides the user with an interface to input control parameters under which the system will operate. The helm control module 14 also provides the user with an audio/visual interface to prompt the user through various steps of automation. Handshaking between the helm control module 14 and the engine control unit 16 is provided through the communication interface 24. Appropriate handshaking through the entire communication allows the helm control module 14 and the engine control unit 16 to work together and communicate with other systems.

The helm control module 14 is in communication with a display 30 and an audible display device 32. The display 30 may be a computer screen or another type of display such as an LCD display, an LED display, or the like. The audible display device 32 may include a speaker, buzzer or other type of audible display for providing feedback to the operator or user. The combination of the display 30 and the audible display device 32 allow visual and audible feedback for programming and controlling various functions.

A user interface 34 is also in communication with the helm control module 14. The user interface 34 may be various types of user interfaces such as a plurality of switches, dials, a keyboard, or other types of buttons. The user interface 34 allows various operating conditions to be performed and monitored. The user interface 34 may also control the display or provide feedback through the display 30 and the audible display device 32. Both the engine control unit 16 and the helm control module 14 may act in concert to control the vessel.

The controller 12 may also control trim tabs 40A and 40B. As illustrated, the trim tab 40A is located on the left or port side of the vessel 10. Trim tab 40B is located on the right or starboard side of the vessel 10. For a planing-type hull vessel, the trim tabs 40A, 40B are coupled to the transom. The trim tabs 40A, 40B may be used to adjust the pitch attitude of the boat while underway. Oftentimes, the trim tabs 40A, 40B are hydraulically actuated. Change in boat speed or weight placement may require the trim tabs 40A, 40B to be adjusted to keep the boat at a comfortable and efficient pitch attitude. The trim tabs 40A, 40B may also be used to correct for listing which is a leaning to one side (or a change about the roll axis) of the vessel. By properly controlling trim tabs 40A, 40B, the boat may achieve an efficient planing angle of the hull relative to the water line. The most efficient planing angle creates the least amount of drag force on the hull. As will be described below, once the trim tabs 40A, 40B are in an optimized position, the outdrive 20 may be modified to accommodate the angle of the vessel. Not all vessels include trim tabs and thus the outdrive may be modified to provide increased fuel economy as will be described below.

Various sensors may also be in communication with the controller 12. A gyroscope 50 may generate signals corresponding to the attitude of the vessel. For example, the gyroscope 50 may provide a pitch of the hull and a roll angle of the hull, which corresponds to listing. A vessel speed sensor 52 generates a speed corresponding to the speed of the vessel. An engine speed sensor 54 generates a signal corresponding to the speed of the engine 18. A global positioning system 56 may also be used to determine the speed of the vessel as well as other operating parameters. Some or all of the sensors may be included in an embodiment of the system.

The controller 12 and the engine 18 may be in communication with a controller area network (CAN) for communicating with various components and sensors within the vessel.

Figure 2:
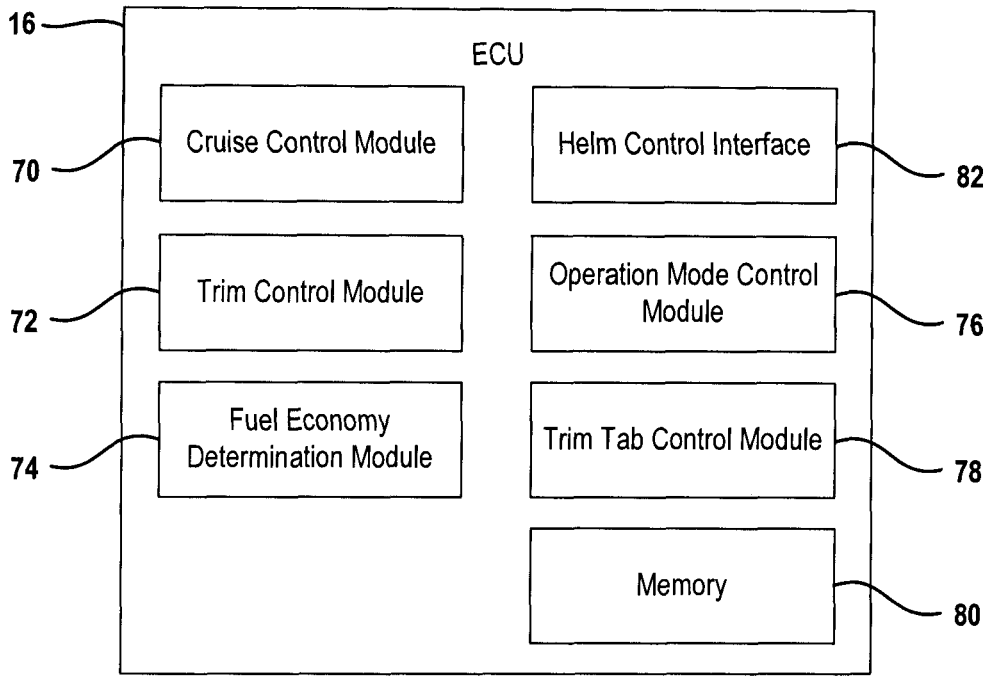
FIG. 2 is a functional block diagram of the engine controller of FIG. 1.

Referring now to FIG. 2, the engine control unit 16 is illustrated in further detail. The engine control unit 16 may include a cruise control module 70 used for controlling the engine to maintain a predetermined speed or a range of predetermined speeds.

A trim control module 72 controls the angle of the outdrive relative to the hull. The pitch of the outdrive affects the pitch of the vessel. As will be described below, the trim control module 72 may move the outdrive into various positions so that fuel economy may be determined. A fuel economy determination module 74 determines the fuel economy of the vessel when operating with various conditions.

An operation mode control module 76 is used to control the operation of the vessel. The operation mode control module 76 may also be located in the helm control interface. The operation mode control module 76 may control the operation of the vessel in a fuel economy mode with the trim positions or trim tab positions for efficient operation as determined below. The operation mode control module 76 may control the learning of a fuel efficient mode of the vessel by operating in a run-on-the-fly mode controlled by the driver, an auto-learn mode, or in a calibrated mode. The run-on-the-fly mode allows the operator or driver of the vessel to execute the process to operate in a fuel efficiency mode for a particular trip. The auto-learn mode may be provided for a given speed. That is, there may be a consistent optimum vessel configuration that may be learned and placed into memory 80 a first time in operation. From then on, the automated fuel economy system may continually reference the learned values. The system may also provide calibrations stored within the memory 80 that are provided by the manufacturer of the vessel. The dealer may also provide calibrations that are stored in the memory 80.

A helm control interface 82 may also be contained within the electronic control module. The helm control interface 82 controls the handshaking between the engine control unit 16 and the helm control module 14.

Figure 3:
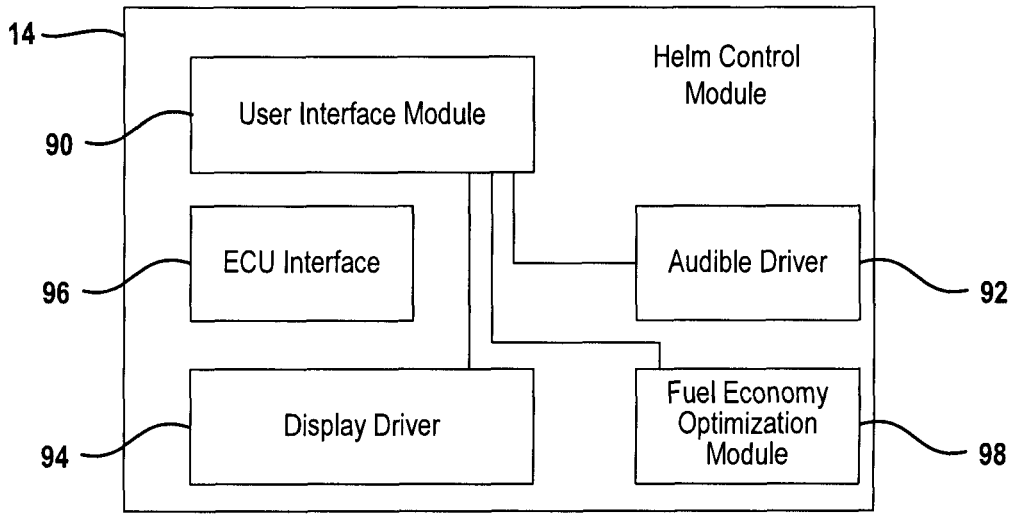
FIG. 3 is a functional block diagram of the helm control module of FIG. 1.

Referring now to FIG. 3, the helm control module 14 is illustrated in further detail. The helm control module 14 may include a user interface module 90 that is used to interface with the user interface 34, the display 30 and the audible display 32 of FIG. 1. Various inputs and outputs are controlled by the user interface module 90. The user interface module 90 may be in communication with an audible driver 92 and a display driver 94 for interfacing with the audible display 32 and the visual display 30, respectively. The helm control module 14 may also be in communication with the engine control unit 16 through the ECU interface 96. The ECU interface 96 controls the handshaking at the helm control module between the helm control module 14 and the helm control interface 82.

The helm control module 14 may also include a fuel economy optimization module 98. The fuel economy optimization module 98 may provide an automated system for optimizing the fuel economy for a vessel. The fuel economy optimization module 96 may be implemented in software and provide commands and receive inputs through the user interface module 90.

Figure 4:
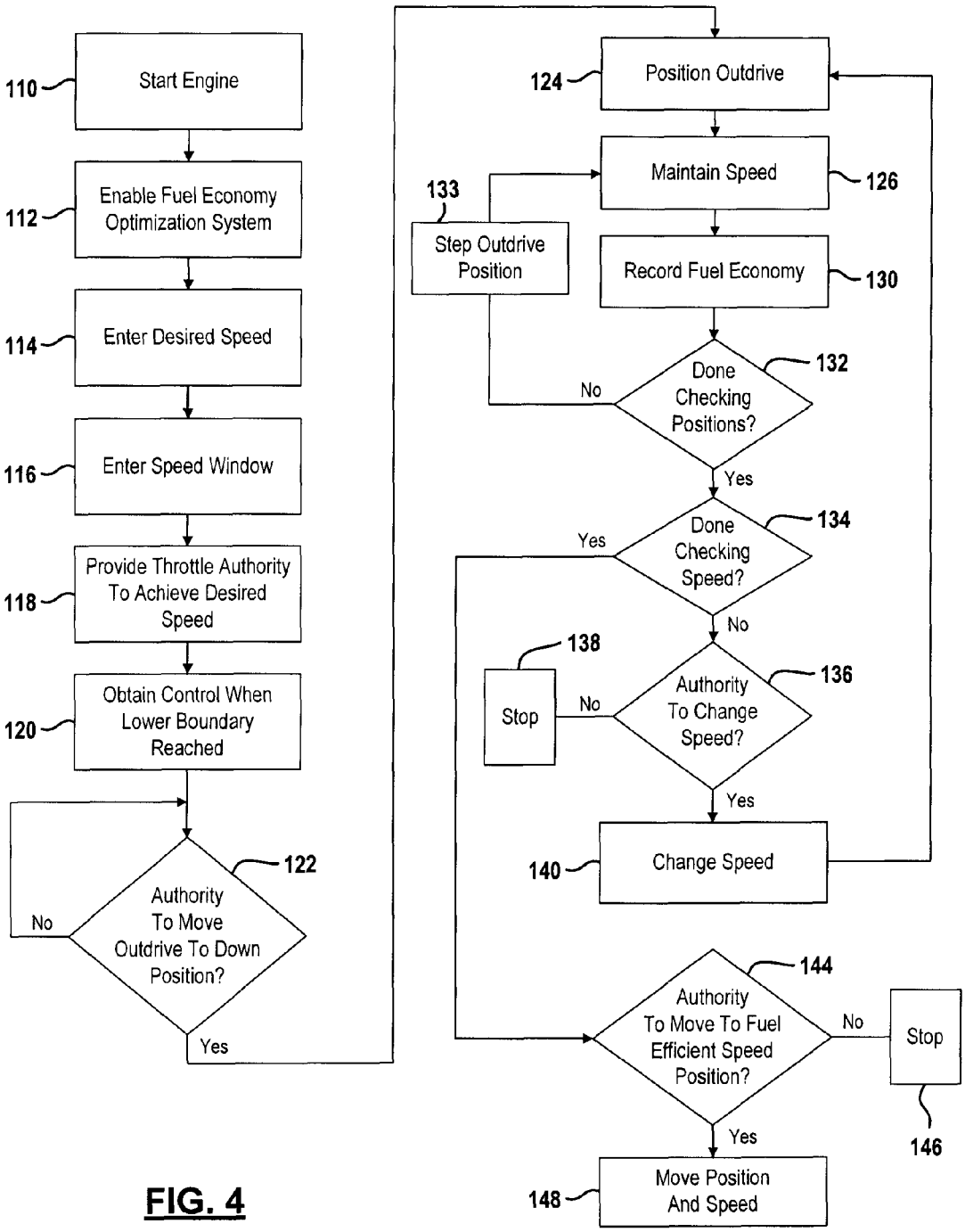
FIG. 4 is a flowchart illustrating steps executed by a first embodiment of the system.

Referring now to FIG. 4, a method for determining the optimal vessel characteristics for a desired engine speed or vessel speed to achieve the best fuel economy is set forth. The system evaluates a matrix of the vessel and engine conditions as well as the operating conditions of the engine 18 and outdrive 20 of FIG. 1. In the following example, the fuel efficiency is controlled by controlling the outdrive.

The process begins in step 110 when the engine is started. In step 112, the automated fuel economy optimization system is enabled. In step 114, a desired speed is entered into the helm control module 14 through the user interface module 90 of FIG. 3. The desired speed may be an engine speed or a vessel speed. In step 116, a speed window is entered. The speed window includes an upper speed boundary and a lower speed boundary. For example, plus or minus two miles per hour or plus or minus two hundred revolutions per minute (RPM) may be set. The window will provide the ability to test different set speeds that may have significantly better fuel economy due to the engine or vessel characteristics.

In step 118, throttle authority is provided by the operator to achieve the desired vessel speed or engine speed. In step 120, control of the vessel is obtained by the cruise control module 70 and the engine control unit 16 when the lower boundary of the speed window is reached. The system may always be removed from automated control by bringing the throttle to an idle position.

In step 122, authority must be provided by the operator to move the outdrive into a first position such as a fully lowered position. If authority is not given, step 122 is provided again. When authority is provided by the operator, step 124 is performed. In step 124, the outdrive is positioned in the lowest position. When the outdrive is positioned in lowermost position, the engine control unit 16 maintains the speed. The fuel economy is recorded in step 130. The fuel economy is recorded after a steady state position has been reached for the particular trim angle. The fuel economy is stored within a memory such as the memory 78 in FIG. 2. In step 132, it is determined whether or not each position of the outdrive has been checked for fuel economy at the speed. If the fuel economy has not been checked at all of the outdrive positions, step 133 is performed and the fuel economy recorded for the new outdrive position. In step 132, if all of the positions of the outdrive at the current speed are performed, step 134 checks to determine whether or not all of the speeds have been checked. In this example, all of the speeds within the window at various increments may be checked for fuel economy. If all of the speeds have not been checked in step 134, step 136 asks for authority to change speeds. This may be performed using the helm control module. If authority is not provided to change speed, step 138 stops the process. In step 136, if authority is provided to change the speed, step 140 changes the speed and step 126 is used to maintain the new speed during stepping of the outdrive into various positions and recording the fuel economy in steps 124-134 for the new speed.

Referring back to step 134, when the system is done checking each position and each speed, step 144 asks for the authority to move the vessel into the best fuel economy or most fuel efficient speed and position. If authority is not provided, step 146 stops the process. In step 144, if authority is provided to move the vessel into the most efficient speed and position, step 148 changes the angle of the outdrive and the ECU 16 changes the speed so that the trim angle and the speed are in the most fuel efficient positions. This is performed by comparing each of the fuel economies for each of the speed and trim position combinations for the outdrive. The vessel may be operated in this position until authority is removed.

Figure 5:
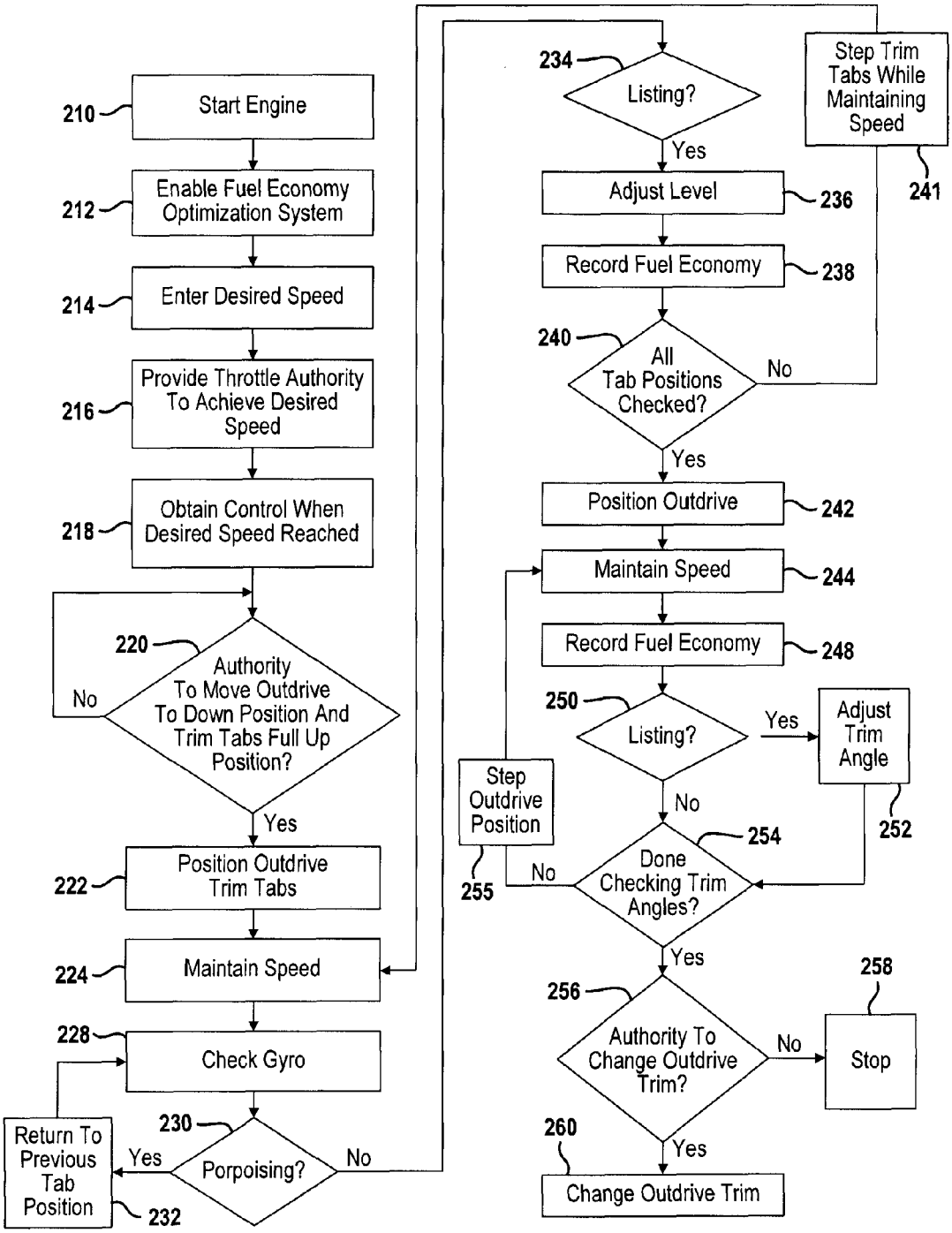
FIG. 5 is a flowchart illustrating steps executed by a second embodiment of the system.

Referring now to FIG. 5, a second method is provided for a vessel that includes both an outdrive trim and trim tabs as opposed to only the outdrive as provided in FIG. 4. In step 210, the engine is started. In step 212, the fuel economy optimization system is enabled. In step 214, a desired speed is entered through the helm control module 14 of FIG. 1. In this embodiment, only one speed is set forth. However, various speeds may also be checked as described above in FIG. 4.

In step 216, throttle authority is provided by the operator to achieve the desired vessel speed or engine speed. In step 218, the engine control unit and cruise control module 70 of FIG. 2 obtains control of the engine when the engine speed or vessel speed reaches the desired speed from step 216. As described above, once the system is in control, the driver may exit the automated system by placing the throttle back into an idle position.

In step 220, the system asks for the authority to move the outdrive into a first position such as a fully down position and move the trim tabs up to a first position such as a fully up position. Until this is performed, step 220 is continually performed. Once the outdrive is in the fully down position and the trim tabs are in the fully up position, step 222 positions the outdrive trim tabs. Step 224 maintains the vessel with the current engine speed or vessel speed. The pitch of the vessel is checked by using the gyroscope. Step 230 determines whether the vessel is porpoising due to a change in the trim. Porpoising is the movement of the bow of the boat up and down. This is an unstable position rather than a consistent smooth planar position. If the vessel is porpoising in step 230, the previous tab position is achieved in step 232. After step 232, step 228 is performed.

If the system is not porpoising in step 230, it is determined whether the vessel is listing or leaning to one side in step 234. If the system is listing in step 234, the system adjusts the roll angle of the vessel by adjusting one of the trim tabs independently in step 236 depending on the angle. The fuel economy is recorded for the trim tab position in step 238. If all the trim tab positions have not been checked, step 241 is performed where the trim tabs are positioned into a different position. Thereafter, step 224 is performed. In step 240, when all of the trim tab positions have been checked, the most fuel efficient trim tab position is determined by comparing all of the fuel economies recorded for all the different trim tab positions.

In step 242, the position of the outdrive is then checked for various fuel economies while maintaining the efficient trim tab position. In step 244, the speed of the vessel is maintained and the outdrive position is stepped to a new position. The fuel economy for the outdrive trim position is recorded in step 248. If the vehicle is listing due to adjustment of the trim angle in step 250, the trim angle is adjusted in step 252 to remove the listing. After step 250, if the vehicle is not listing or after the adjustment of the trim angle in step 252, step 254 determines whether or not each of the trim angles have been checked. In step 254, if all of the trim angles have not been checked, step 255 is performed which steps the outdrive. Thereafter, steps 244-252 are again performed for the new or adjusted trim angle.

When all of the trim angles have been tested and the fuel economy recorded for each trim angle with a particular trim tab setting, step 256 asks for authority to change the outdrive trim to the most fuel efficient outdrive trim. If authority is not provided by the operator in step 256, the system stops operation in step 258. If authority has been provided to change the outdrive trim, step 260 changes the outdrive trim. The trim tabs are maintained in the previously set most fuel efficient position.

As described above, the calibration may be stored in the memory for the most efficient trim angle and/or trim tab position. The calibration may be performed by the vessel manufacturer or by the dealer. An auto-learn configuration may also be performed by the operator and stored in the memory. Once learned, the most fuel efficient outdrive angle and trim position may easily be determined without performing the calibration again. If conditions change, such as weather, water conditions and weight, the system may be invoked to perform the optimization again.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A system for operating a marine vessel comprising:

a cruise control module that operates the marine vessel at a plurality of speeds;

a trim control module that positions an outdrive into a trim position while the marine vessel is operated at the plurality of speeds;

a fuel economy determination module that determines a fuel economy for each of the speeds and the trim position, and that selects a first speed from the plurality of speeds based on the fuel economy; and an operation control module that operates the marine vessel at the first speed and the trim position.

2. A system as recited in claim 1 wherein:

the trim position comprises a plurality of trim positions;

the cruise control module operates the marine vessel at the plurality of trim positions at each of the plurality of speeds;

the fuel economy determination module determines the fuel economy for each of the trim positions at each of the speeds and selects a first trim position from the plurality of trim positions based on the fuel economy; and the operation control module operates the marine vessel at the first speed and the first trim position.

3. A system for operating a marine vessel comprising:

a cruise control module that establishes a window of speeds having an upper speed and a lower speed and that operates the marine vessel at a plurality of speeds within the window of speeds;

a trim control module that positions an outdrive into a plurality of trim positions at each of the plurality of speeds within the window of speeds;

a fuel economy determination module that determines a fuel economy for each of the speeds and that selects a first speed from the plurality of speeds based on the fuel economy; and an operation control module that operates the marine vessel at the first speed.

4. A system as recited in claim 3 wherein the speeds comprise a constant engine speed.

5. A system as recited in claim 3 wherein the speeds comprise a constant vessel speed.

6. A system as recited in claim 3 wherein the fuel economy determination module determines the fuel economy at each of the plurality of trim positions and selects a first trim position from the plurality of trim positions based on the fuel economy and wherein the operation mode control module operates the marine vessel at the first speed and the first trim position.

7. A system as recited in claim 3 wherein the trim control module positions the outdrive in a downward position.

8. A system as recited in claim 3 further comprising a trim tab control module that positions a trim tab in a plurality of trim tab positions while the cruise control module maintains one of the speeds and the fuel economy determination module determines the fuel economy at each of the trim tab positions.

9. A system as recited in claim 8 wherein the fuel economy determination module selects a first trim tab position from the plurality of trim tab positions based on the fuel economy before the trim control module positions the outdrive into the plurality of trim positions.

10. A system as recited in claim 9 wherein the fuel economy determination module determines the fuel economy at each of the plurality of speeds while the trim control module maintains the first trim tab position.

11. A method of operating a marine vessel comprising:

operating the marine vessel at a plurality of speeds;

positioning an outdrive into a trim position while the marine vessel is operated at the plurality of speeds;

determining a fuel economy for each of the speeds and the trim position;

selecting a first speed from the plurality of speeds based on the fuel economy; and operating the marine vessel at the first speed and the trim position.

12. A method as recited in claim 11 wherein the trim position comprises a plurality of trim positions, the method further comprising:

positioning the outdrive into the plurality of trim positions at each of the plurality of speeds;

determining the fuel economy for each of the trim positions at each of the speeds;

selecting a first trim position from the plurality of trim positions based on the fuel economy; and operating the marine vessel at the first speed and the first trim position.

13. A method of operating a marine vessel comprising:

establishing a window of speeds having an upper speed and a lower speed;

operating the marine vessel at a plurality of speeds within the window of speeds;

positioning an outdrive into a plurality of trim positions at each of the plurality of speeds within the window of speeds;

determining a fuel economy for each of the speeds;

selecting a first speed from the plurality of speeds based on the fuel economy; and operating the marine vessel at the first speed.

14. A method as recited in claim 13 wherein operating the marine vessel at a plurality of speeds comprises operating the marine vessel at a constant engine speed.

15. A method as recited in claim 13 wherein operating the marine vessel at a plurality of speeds comprises operating the marine vessel at a constant vessel speed.

16. A method as recited in claim 13 further comprising determining the fuel economy at each of the plurality of trim positions, selecting a first trim position from the plurality of trim positions based on the fuel economy, and operating the marine vessel at the first speed and the first trim position.

17. A method as recited in claim 13 wherein positioning comprises positioning the outdrive in a downward position.

18. A method as recited in claim 13 further comprising positioning a trim tab in a plurality of trim tab positions while maintaining one of the speeds.

19. A method as recited in claim 18 further comprising positioning the outdrive into the plurality of trim positions after:

i) positioning the trim tab in the plurality of trim tab positions while maintaining the outdrive in a downward position;

ii) determining the fuel economy at each of the plurality of trim tab positions; and iii) selecting a first trim tab position from the plurality of trim tab positions based on the fuel economy.

20. A method as recited in claim 19 wherein determining a fuel economy for each of the speeds comprises determining a fuel economy for each of the trim positions at each of the speeds while maintaining the first trim tab position.

* * * * *